US010335632B2

(12) United States Patent
Baker

(10) Patent No.: US 10,335,632 B2
(45) Date of Patent: Jul. 2, 2019

(54) TREADMILL INCLUDING A DECK LOCKING MECHANISM

(71) Applicant: Nautilus, Inc., Vancouver, WA (US)

(72) Inventor: Bryce C. Baker, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 238 days.

(21) Appl. No.: 14/985,516

(22) Filed: Dec. 31, 2015

(65) Prior Publication Data

US 2017/0189744 A1 Jul. 6, 2017

(51) Int. Cl.

| | |
|---|---|
| ***A63B 22/02*** | (2006.01) |
| ***A63B 69/00*** | (2006.01) |
| ***A63B 71/06*** | (2006.01) |

(52) U.S. Cl.

CPC ..... *A63B 22/02* (2013.01); *A63B 69/0057* (2013.01); *A63B 71/0619* (2013.01); *A63B 2210/50* (2013.01); *A63B 2210/56* (2013.01); *A63B 2225/50* (2013.01)

(58) Field of Classification Search

CPC ..... A63B 22/02; A63B 21/00058; A63B 21/00069; A63B 21/00072; A63B 21/00181; A63B 21/00185; A63B 21/008; A63B 21/0083; A63B 21/0085; A63B 21/0087; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/15; A63B 21/151; A63B 21/152; A63B 21/158; A63B 21/159; A63B 21/4027; A63B 21/4033; A63B 21/4034; A63B 21/4041; A63B 21/4045; A63B 22/0046; A63B 69/0057; A63B 2210/00; A63B 2210/50; A63B 2210/52; A63B 2210/54; A63B 2210/56; A63B 2225/09; A63B 2225/093; A63B 2225/72

See application file for complete search history.

(56) References Cited

U.S. PATENT DOCUMENTS

| | | | | |
|---|---|---|---|---|
| 3,596,554 A | | 8/1971 | Low et al. | |
| 3,826,491 A | | 7/1974 | Elder | |
| 4,599,996 A | * | 7/1986 | Seith | A61F 13/041 482/51 |
| 4,679,787 A | * | 7/1987 | Guilbault | A47C 17/38 482/54 |
| 4,757,987 A | * | 7/1988 | Allemand | A63B 22/02 482/54 |

(Continued)

FOREIGN PATENT DOCUMENTS

TW 408611 B 10/2000

OTHER PUBLICATIONS

NordicTrack C900 User's Manual (NordicTrack, 2010).*
NordicTrack c200 Treadmill User Manual, ICON Health and Fitness, Inc, 2014., 40 pages.

*Primary Examiner* — Gary D Urbiel Goldner
(74) *Attorney, Agent, or Firm* — Dorsey & Whitney LLP

(57) ABSTRACT

A treadmill may include a lock mechanism operative to selectively lock a deck assembly in one or more positions relative to a base frame. The lock mechanism may include an engagement member that locks the deck assembly in an operating position while allowing incline adjustment of the deck assembly relative to the frame during use of the treadmill.

17 Claims, 7 Drawing Sheets

(56) References Cited

U.S. PATENT DOCUMENTS 4,913,396 A 4/1990 Dalebout et al.
4,921,247 A * 5/1990 Sterling ..... A63B 17/00 482/130
5,029,801 A * 7/1991 Dalebout ..... A63B 22/0023 248/649
5,085,426 A 2/1992 Wanzer et al.
5,104,119 A 4/1992 Lynch
5,184,988 A 2/1993 Dunham
5,513,825 A 5/1996 Gutgsell
5,518,471 A 5/1996 Hettinger et al.
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,702,325 A 12/1997 Watterson et al.
5,733,228 A 3/1998 Stevens
5,746,682 A * 5/1998 Hung ..... A63B 22/02 482/51
5,772,560 A 6/1998 Watterson et al.
5,782,723 A * 7/1998 Kuo ..... A63B 22/02 482/51
5,788,611 A * 8/1998 Kuo ..... A63B 22/02 402/54
5,813,947 A * 9/1998 Densmore ..... A63B 22/205 482/51
5,816,981 A * 10/1998 Hung ..... A63B 22/02 482/54
5,830,113 A 11/1998 Coody et al.
5,839,993 A * 11/1998 Fox ..... A63B 22/02 482/54
5,855,537 A 1/1999 Coody et al.
5,860,893 A 1/1999 Watterson et al.
5,860,894 A 1/1999 Dalebout et al.
5,868,648 A 2/1999 Coody et al.
5,897,460 A * 4/1999 McBride ..... A63B 22/0012 482/51
5,921,893 A * 7/1999 Hurt ..... A63B 22/02 482/51
6,015,368 A 1/2000 Clem et al.
6,033,347 A * 3/2000 Dalebout ..... A63B 22/02 482/54
6,050,923 A * 4/2000 Yu ..... A63B 22/0023 482/51
6,077,200 A * 6/2000 Lin ..... A63B 22/02 482/51
6,090,014 A 7/2000 Eschenbach
6,110,077 A * 8/2000 Yu ..... A63B 22/0235 482/51
6,213,919 B1 * 4/2001 Wang ..... A63B 22/02 482/54
6,261,209 B1 * 7/2001 Coody ..... A63B 22/0023 482/51
6,312,363 B1 11/2001 Watterson et al.
6,325,745 B1 * 12/2001 Yu ..... A63B 22/0023 482/51
6,383,120 B1 5/2002 Lo
6,387,016 B1 * 5/2002 Lo ..... A63B 22/0023 482/51
6,398,696 B1 6/2002 Tsou
6,461,275 B1 10/2002 Wang et al.
6,471,622 B1 10/2002 Hammer et al.
6,475,121 B2 11/2002 Wang et al.
6,527,679 B2 * 3/2003 Wang ..... A63B 22/0235 482/51
6,579,211 B2 * 6/2003 Wu ..... A63B 22/0023 482/54
6,592,496 B1 7/2003 Tsou
6,638,200 B2 * 10/2003 Chang ..... A63B 22/0023 482/54
6,652,424 B2 11/2003 Dalebout
6,695,751 B1 * 2/2004 Hsu ..... A63B 22/02 482/54
6,723,027 B1 * 4/2004 Lo ..... A63B 22/02 482/54
6,726,602 B2 * 4/2004 Chang ..... A63B 22/0023 482/54
6,746,376 B2 * 6/2004 Chang ..... A63B 22/02 482/54
6,758,791 B1 7/2004 Kuo
6,811,518 B2 * 11/2004 Lin ..... A63B 22/02 482/51
6,830,540 B2 12/2004 Watterson et al.
6,843,757 B2 1/2005 Pan et al.
6,855,095 B2 * 2/2005 Chang ..... A63B 22/0235 482/54
6,857,991 B2 2/2005 Yu
6,872,169 B2 * 3/2005 Kuo ..... A63B 22/0023 482/51
6,884,201 B2 4/2005 Wu
6,905,443 B1 * 6/2005 Lo ..... A63B 22/0023 482/54
6,913,563 B2 7/2005 Chen
6,916,277 B2 7/2005 Chen
6,923,747 B1 * 8/2005 Chu ..... A63B 22/02 482/54
6,926,644 B2 8/2005 Chen
6,964,632 B1 * 11/2005 Ko ..... A63B 22/0023 482/54
6,974,404 B1 12/2005 Watterson et al.
6,979,283 B2 12/2005 Pan et al.
6,984,193 B2 1/2006 Chen
6,997,852 B2 2/2006 Watterson et al.
7,004,887 B2 2/2006 Pan et al.
7,037,242 B2 5/2006 Lo et al.
7,081,069 B2 7/2006 Hsu
7,097,594 B2 * 8/2006 Lo ..... A63B 22/0235 482/54
7,097,595 B1 * 8/2006 Wang ..... A63B 22/0023 482/54
7,104,930 B2 * 9/2006 Lo ..... A63B 22/02 482/51
7,104,937 B2 9/2006 Arbuckle et al.
7,166,065 B2 * 1/2007 Chang ..... A63B 22/0023 482/54
7,179,203 B2 * 2/2007 Pan ..... A63B 22/0023 482/54
7,192,388 B2 3/2007 Dalebout
7,211,029 B2 5/2007 Kau
7,285,075 B2 10/2007 Cutler et al.
7,344,481 B2 3/2008 Watterson et al.
7,377,879 B1 5/2008 Chen
7,381,160 B2 * 6/2008 Lo ..... A63B 22/02 482/51
7,413,529 B2 8/2008 Lee et al.
7,455,622 B2 11/2008 Watterson et al.
7,455,626 B2 11/2008 Trevino et al.
7,540,828 B2 6/2009 Watterson et al.
7,540,829 B1 * 6/2009 Chen ..... A63B 22/0235 482/51
7,544,153 B2 6/2009 Trevino et al.
7,569,000 B2 8/2009 Wang
7,585,255 B1 * 9/2009 Chen ..... A63B 22/02 482/54
7,628,730 B1 12/2009 Watterson et al.
7,645,213 B2 1/2010 Watterson et al.
7,717,829 B2 5/2010 Wang
7,722,507 B2 5/2010 Yoo
7,736,280 B2 6/2010 Weier et al.
7,749,138 B2 * 7/2010 Wang ..... A63B 22/02 482/54
7,789,807 B1 * 9/2010 Wang ..... A63B 22/0235 482/52
7,854,690 B2 12/2010 Trevino et al.
7,862,478 B2 1/2011 Watterson et al.
7,867,147 B2 * 1/2011 Chu ..... A63B 22/02 482/51
7,914,421 B2 3/2011 Weier et al.

(56) References Cited

U.S. PATENT DOCUMENTS 8,079,939 B1* 12/2011 Wang ..... A63B 22/0235 482/54
8,251,874 B2 8/2012 Ashby et al.
8,657,724 B2 2/2014 Yang
8,734,303 B2 5/2014 Huang et al.
8,920,291 B2 12/2014 Chen et al.
9,039,578 B2 5/2015 Dalebout
9,044,638 B2 6/2015 Huang et al.
9,095,740 B2 8/2015 Wu
9,138,615 B2 9/2015 Olson et al.
9,168,414 B2 10/2015 Liu et al.
9,168,415 B2 10/2015 Liu et al.
9,289,648 B2 3/2016 Watterson
9,707,441 B2 7/2017 Yang
2002/0147078 A1 10/2002 Wu
2002/0173408 A1* 11/2002 Wang ..... A63B 22/0235 482/54
2003/0004037 A1* 1/2003 Wang ..... A63B 22/02 482/54
2003/0060334 A1* 3/2003 Lo ..... A63B 22/0023 482/51
2003/0125166 A1* 7/2003 Chang ..... A63B 22/02 482/54
2003/0195088 A1 10/2003 Wang et al.
2003/0216226 A1* 11/2003 Chen ..... A63B 22/02 482/54
2004/0116255 A1* 6/2004 Chen ..... A63B 22/02 482/54
2004/0138030 A1 7/2004 Wang et al.
2004/0152564 A1* 8/2004 Kuo ..... A63B 22/0023 482/54
2004/0204296 A1* 10/2004 Maenpaa ..... A63B 22/0023 482/54
2004/0242380 A1* 12/2004 Kuivala ..... A63B 22/02 482/54
2005/0009667 A1* 1/2005 Chen ..... A63B 22/02 482/54
2005/0096189 A1* 5/2005 Chen ..... A63B 22/0023 482/54
2005/0148442 A1* 7/2005 Watterson ..... A63B 22/0023 482/54
2005/0159273 A1* 7/2005 Chen ..... A63B 22/02 482/54
2005/0255969 A1* 11/2005 Smith ..... A63B 22/0023 482/54
2006/0003869 A1* 1/2006 Huang ..... A63B 22/02 482/54
2006/0122037 A1* 6/2006 Chou Lin ..... A63B 22/0235 482/54
2006/0287162 A1* 12/2006 Lo ..... A63B 22/02 482/54
2007/0015634 A1* 1/2007 Ho ..... A63B 21/0084 482/54
2007/0066448 A1* 3/2007 Pan ..... A63B 22/0235 482/54
2007/0087908 A1 4/2007 Pan et al.
2007/0191190 A1* 8/2007 Kuo ..... A63B 22/0023 482/54
2008/0004162 A1* 1/2008 Chen ..... A63B 22/02 482/54
2008/0188358 A1* 8/2008 Kuo ..... A63B 22/02 482/54
2008/0248935 A1 10/2008 Solow et al.
2008/0280734 A1* 11/2008 Dickie ..... A63B 22/0023 482/54
2008/0312046 A1* 12/2008 Lin ..... A63B 22/02 482/54
2009/0005224 A1* 1/2009 Davis ..... A63B 22/02 482/54
2009/0062072 A1* 3/2009 Packham ..... A63B 22/02 482/4
2009/0069159 A1* 3/2009 Wang ..... A63B 22/02 482/54
2009/0093347 A1* 4/2009 Wang ..... A63B 22/0235 482/54
2009/0124465 A1* 5/2009 Wang ..... A63B 22/02 482/54
2009/0124466 A1* 5/2009 Zhang ..... A63B 22/02 482/54
2009/0163327 A1* 6/2009 Huang ..... A63B 22/02 482/54
2009/0239716 A1* 9/2009 Wang ..... A63B 22/0235 482/54
2010/0029444 A1* 2/2010 Lo ..... A63B 22/0257 482/54
2011/0021323 A1* 1/2011 Wu ..... A63B 22/0235 482/54
2012/0115686 A1* 5/2012 Wang ..... A63B 22/0235 482/54
2012/0165161 A1* 6/2012 Chen ..... A63B 22/02 482/54
2013/0190136 A1 7/2013 Watterson
2013/0237381 A1 9/2013 Chen et al.
2013/0237383 A1* 9/2013 Chen ..... A63B 22/02 482/54
2013/0267386 A1 10/2013 Her
2015/0182782 A1* 7/2015 Cutler ..... A63B 22/0046 403/84
2017/0189745 A1* 7/2017 Hamilton ..... A63B 22/02
2017/0266481 A1 9/2017 Dalebout
2018/0117385 A1 5/2018 Watterson et al.

* cited by examiner 138b
252
140a
214
136 140
256
10
216
140b
146
142
138
138a
254

252
136
140
214
12
138b
12
146
142
140b
256
138
216
254

220a
220
210
228
224
218
138
232
140
146
216
234
256
142
202
254

220a
216b
230
220
228
210
224
218
138
146
140
229
216
216a
202
142
254
256

TREADMILL INCLUDING A DECK LOCKING MECHANISM

TECHNOLOGICAL FIELD

The present disclosure generally relates to exercise machines, and more particularly, to a treadmill including a lock mechanism.

BACKGROUND

Exercise treadmills generally cover a substantial amount of floor space when in an operating or use configuration. As such, many exercise treadmills include a deck assembly that is pivotally connected to a frame. The deck assembly is positionable between a generally horizontal operating or use position and a generally upright storage position to reduce the amount of floor space taken up by the treadmill when not in use. To hold the deck assembly in the generally upright storage position, various types of lock mechanisms have been developed and commercialized. Improvements in the field may be desirable for continuing to improve the user's experience.

SUMMARY

In accordance with the present disclosure, a treadmill may include a frame; a deck assembly including a front end portion pivotally connected to the frame, the deck assembly positionable in an operating position and a storage position; a first tube connected to one of the frame or the deck assembly, the first tube defining a first engagement feature and a second engagement feature; a second tube connected to the other of the frame or the deck assembly and slidably connected to the first tube; and a lock mechanism operative to lock the deck assembly in the operating position and the storage position. The lock mechanism may include an engagement member operatively connected to the second tube and engageable with the first engagement feature and the second engagement feature of the first tube. Engagement of the engagement member with the first engagement feature may lock the deck assembly in the storage position, and engagement of the engagement member with the second engagement feature may lock the deck assembly in the operating position while allowing incline adjustment of the front end portion of the deck assembly relative to the frame during operation of the treadmill.

In some embodiments, engagement of the engagement member with the first engagement feature substantially prevents the deck assembly from being moved relative to the frame.

In some embodiments, disengagement of the engagement member from the first and second engagement features allows the deck assembly to be moved relative to the frame between the operating position and the storage position.

In some embodiments, the second engagement feature comprises a slot formed in the first tube dimensioned to receive at least a portion of the engagement member, and the slot extends lengthwise along a length of the first tube.

In some embodiments, the slot is dimensioned to allow the engagement member to slide in a straight line within the slot along the length of the first tube.

In some embodiments, the first engagement feature comprises an aperture formed in the first tube, and the aperture is dimensioned to receive at least a portion of the engagement member and substantially prevent the deck assembly from being moved relative to the frame.

In some embodiments, the first tube includes a first end portion pivotally connected to the one of the frame or the deck assembly and a second end portion distal the first portion, and the second engagement feature is located between the first engagement feature and the first end portion of the first tube.

In some embodiments, the second tube includes a first end portion pivotally connected to the other of the frame or the deck assembly and a second end portion distal the first portion, and the engagement member is connected to the second tube proximate the second end portion of the second tube.

In some embodiments, the engagement member is slidable between a first position in which the engagement member is engaged with the first engagement feature or the second engagement feature and a second position in which the engagement member is disengaged from the first and second engagement features.

In some embodiments, the treadmill further includes a biasing member that biases the engagement member towards the first position.

In some embodiments, the treadmill further includes an actuator member positioned remote from the engagement member and operatively associated with the engagement member to disengage the engagement member from the first and second engagement features.

In some embodiments, the actuator member is movably connected to the deck assembly to disengage the engagement member from the first and second engagement features.

In some embodiments, the actuator member is pivotally connected to the deck assembly such that pivotal motion of the actuator member relative to the deck assembly disengages the engagement member from the first and second engagement features.

In some embodiments, the deck assembly has a rear end portion distal the front end portion, and the actuator member is pivotally connected to the rear end portion of the deck assembly.

In some embodiments, the treadmill further includes a cable that operatively connects the actuator member to the engagement member.

In some embodiments, the treadmill further includes a biasing member operatively connected to the actuator member to bias the engagement member towards an engaged position.

In some embodiments, the treadmill further includes a lift assistance mechanism operatively connected to the frame and the deck assembly.

In some embodiments, the lift assistance mechanism is at least partially received inside the first and second tubes.

In some embodiments, the first tube is telescopically received in the second tube.

In accordance with the present disclosure, a method of locking a deck assembly of a treadmill in an operating position may include disengaging an engagement member from a first engagement feature, moving the deck assembly from a storage position into an operating position, engaging the engagement member with a second engagement feature to lock the deck assembly in the operating position, and adjusting the incline of the deck assembly in the operating position while the engagement member is engaged with the second engagement feature.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment.

DETAILED DESCRIPTION

The following description of certain exemplary embodiments is merely exemplary in nature and is in no way intended to limit the claimed invention or its applications or uses. In the following detailed description of embodiments of the present disclosure, reference is made to the accompanying drawings which form a part hereof, and in which are shown by way of illustration specific embodiments in which the described assemblies, mechanisms, systems, and methods may be practiced. These embodiments are described in sufficient detail to enable those skilled in the art to practice the presently disclosed assemblies, mechanisms, systems, and methods, and it is to be understood that other embodiments may be utilized and that structural and logical changes may be made without departing from the spirit and scope of the present disclosure. Moreover, for the purpose of clarity, detailed descriptions of certain features will not be discussed when they would be apparent to those with skill in the art so as not to obscure the description of the present assemblies, mechanisms, systems, and methods. The following detailed description is therefore not to be taken in a limiting sense, and the scope of the present assemblies, mechanisms, systems, and methods is defined only by the appended claims.

Embodiments of the present disclosure generally provide a lock mechanism for use with foldable exercise treadmills. As discussed in more detail below, some treadmills are configured with a deck assembly that is pivotally connected with a frame to provide a user the ability to selectively position the treadmill in an operating configuration or a storage configuration. The deck assembly may be locked in the operating configuration, the storage configuration, or both. When locked in the operating configuration, the inclination of the deck assembly may be adjusted during use of the treadmill. Embodiments of the lock mechanism described and depicted herein can be used with various types of exercise treadmills and should not be construed to be limited to use with the treadmill disclosed herein.

Figure 1:
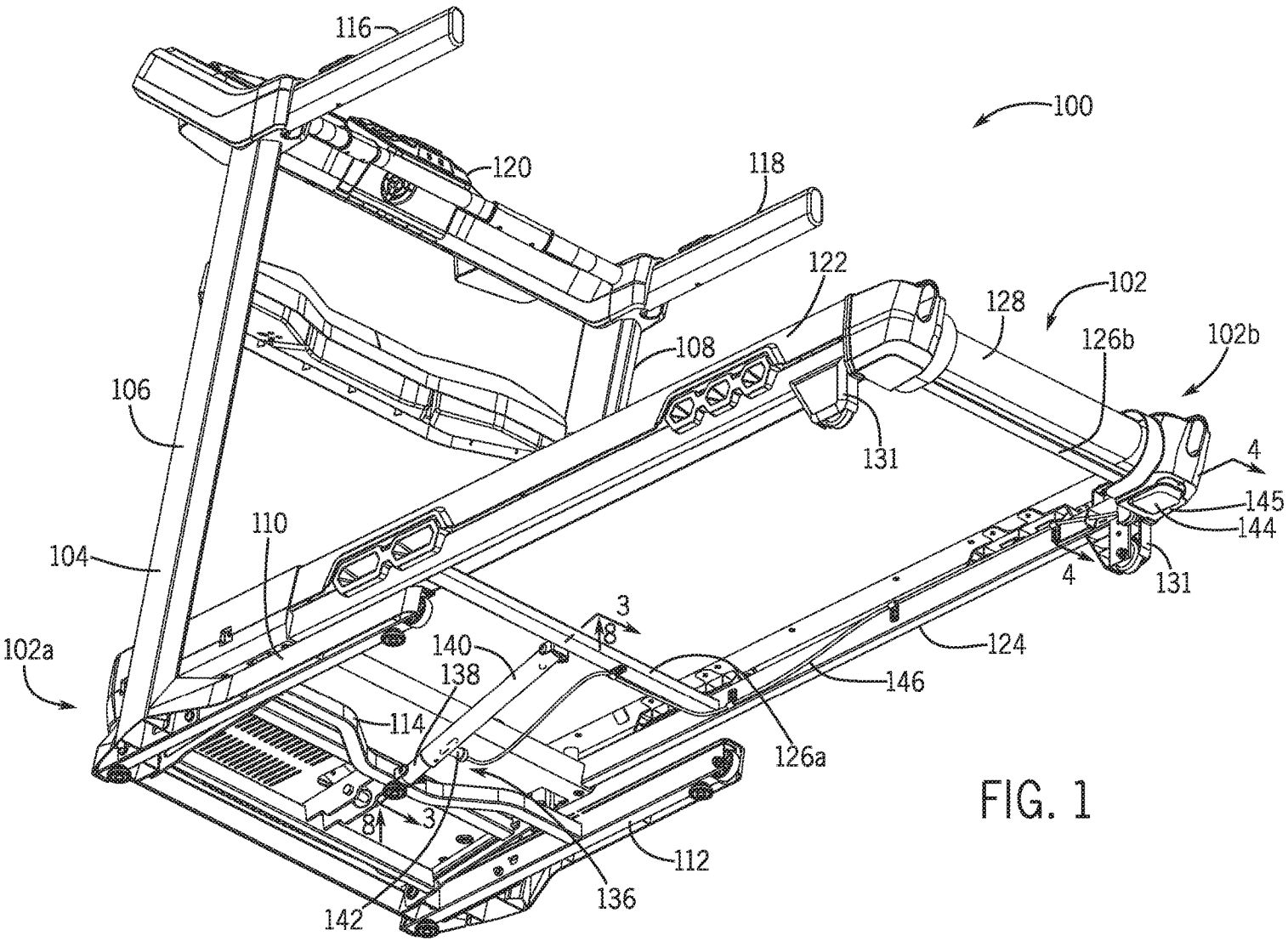
FIG. 1 is a bottom, left side isometric view of a treadmill including a deck assembly in an operating or use position in accordance with one embodiment of the present disclosure.
Figure 2:
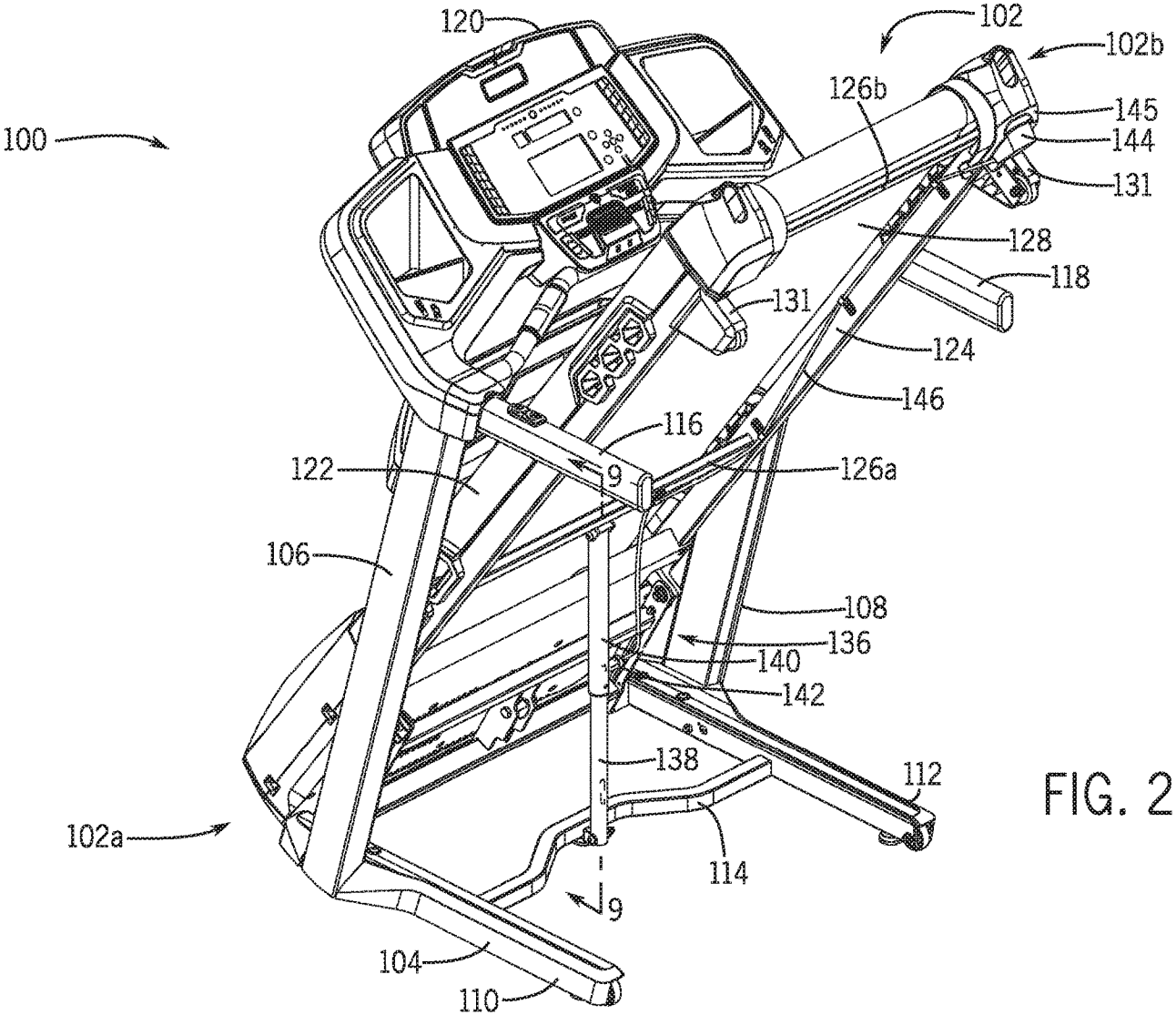
FIG. 2 is a top, left side isometric view of the treadmill of FIG. 1 with the deck assembly in a generally upright storage position according to one embodiment of the present disclosure.

FIGS. 1 and 2 show one example of a treadmill 100 with a lock system adapted to selectively lock the treadmill 100 in an operating configuration and a storage configuration. For example, FIG. 1 shows the treadmill 100 locked in the operating configuration, and FIG. 2 shows the treadmill 100 locked in the storage configuration. As shown in FIGS. 1 and 2, the exercise treadmill 100 includes a deck assembly 102 pivotally connected to a frame 104. A front end portion 102*a* of the deck assembly 102 may be pivotally connected to the frame 104, and a rear end portion 102*b* of the deck assembly 102 may be located distal the front end portion 102*a*. The rear end portion 102*b* of the deck assembly 102 may pivot about a pivotal connection of the front end portion 102*a* to the frame 104. When the treadmill 100 is in the operating configuration of FIG. 1, the deck assembly 102 may be oriented in a generally horizontal position and the rear end portion 102*b* of the deck assembly 102 may be supported by a support surface, such as a floor or the ground. To position the deck assembly 102 in the storage position of FIG. 2, a user may lift the rear end portion 102*b* of the deck assembly 102 upward, causing the deck assembly 102 to pivot around its pivotal connection to the base frame 102 until the deck assembly 102 extends upwardly in a generally vertical position (see FIG. 2).

With continued reference to FIGS. 1 and 2, the base frame 104 may include a left upright member 106 and a right upright member 108 extending upwardly from a left base member 110 and a right base member 112, respectively. The left and right base members 110, 112 may rest on a support surface, such as a floor or the ground, to provide a base or foundation for the treadmill 100 in the operating and storage configurations. A cross member 114, such as a cross bar, may extend between and connect to the left and right base members 110, 112. The cross member 114 may be positioned rearward of the pivotal connection of the deck assembly 102 to the frame 104. To provide a user with upper body support while using the treadmill 100, left and right hand rails 116, 118 may be connected with and extend rearwardly from the left and right upright members 106, 108, respectively. A display console 120 may be supported between the left and right upright members 106, 108.

The deck assembly 102 of FIGS. 1 and 2 may include a left frame rail 122 and a right frame rail 124, both extending rearwardly from the pivotal connection of the deck assembly 102 to the frame 104. The deck assembly 102 may include one or more cross members, such as cross bars, extending between the left and right frame rails 122, 124. For example, in FIGS. 1 and 2, the deck assembly 102 includes a first cross member 126*a* and a second cross member 126*b*. The first cross member 126*a* may be located rearwardly of the cross member 114 of the base frame 104, and the second cross member 126*b* may be located rearwardly of the first cross member 126*a* near the rearward end portion 102*b* of the deck assembly 102.

Referring still to FIGS. 1 and 2, the deck assembly 102 includes a tread belt 128 to provide a walking or running surface on the treadmill 100. The tread belt 128 may move over a treadmill deck 129 (see FIG. 3) between a front roller 130 (see FIG. 3) positioned near the front portion 102*a* of the deck assembly 102 and a rear roller positioned near the rear end portion 102*b* of the deck assembly 102. The front and rear rollers may be rotatably supported between the left and right frame rails 122, 124 of the deck assembly 102. As shown in FIGS. 1 and 2, the rear end portion 102*b* of the deck assembly 102 may include supports 131 extending downwardly from the left and right frame rails 122, 124 to elevate the tread belt 128 above a support surface, such as a floor or the ground, when the deck assembly 102 is in the operating position of FIG. 1. Wheels may be attached to the supports 131 for contact with the ground or floor.

The treadmill 100 of FIGS. 1 and 2 may include a lock system 136 for selectively locking the deck assembly 102 in the operating position of FIG. 1 and/or the storage position of FIG. 2. The lock system 136 may include a first elongate member, illustrated as an inner tube 138, and a second elongate member, illustrated as an outer tube 140, operatively connected to the deck assembly 102 and the frame 104. In FIG. 1, the inner tube 138 is connected to the frame 104 and the outer tube 140 is connected to the deck assembly 102, although the inner tube 138 may be connected to the deck assembly 102 and the outer tube 140 may be connected to the frame 104 without affecting the function of the lock system 136. As illustrated in FIGS. 1 and 2, the inner tube 138 may be slidably received in the outer tube 140 such that the outer tube 140 slides along an outer surface of the inner tube 138 during movement of the deck assembly 102 between the operating position in FIG. 1 and the storage position in FIG. 2.

With continued reference to FIGS. 1 and 2, the lock system 136 may include a lock mechanism 142 operative to lock the deck assembly 102 in the operating position of FIG. 1 and in the storage position of FIG. 2. The lock system 136 may extend between and connect to the deck assembly 102 and the frame 104. For example, in FIGS. 1 and 2, the lock system 136 extends between and connects to the cross member 126*a* of the deck assembly 102 and the cross member 114 of the base frame 104. The lock system 136 may be positioned substantially equidistant between the left and right frame rails 122, 124 along the length of the cross members 114, 126*a*. The lock mechanism 142 may be connected to the outer tube 140 and may selectively engage the inner tube 138 to fix the position of the outer tube 140 relative to the inner tube 138. The lock mechanism 142 may be selectively actuated by an actuator member 144 positioned remote from the lock mechanism 142. The actuator member 144 may be any component capable of disengaging the lock mechanism 142.

The actuator member 144 may be attached to the deck assembly 102. As shown in FIGS. 1 and 2, the actuator member 144 may be connected to the rear end portion 102*b* of the deck assembly 102 to provide easy access for a user. For example, the actuator member 144 may be connected to an end of one of the frame rails 122, 124 and may be located along an underside of the respective frame rail. The actuator member 144 may be substantially covered by a shroud 145 on the underside of the frame 124, with only a portion of the actuator member 144 exposed for actuation by a user. The actuator member 144 may be operatively connected to the lock mechanism 142 by a flexible member, such as cable 146. The cable 146 may be connected to the lock mechanism 142 at a first end, extend along one of the frame rails 122, 124, and be connected to the actuator member 144 at a second end. The cable 146 may be covered by a sheath between the ends of the cable 146. The cable 146 may be held in place along the frame rail 124 by one or more cable guides (e.g., cable guide 147 in FIG. 5).

Figure 3:
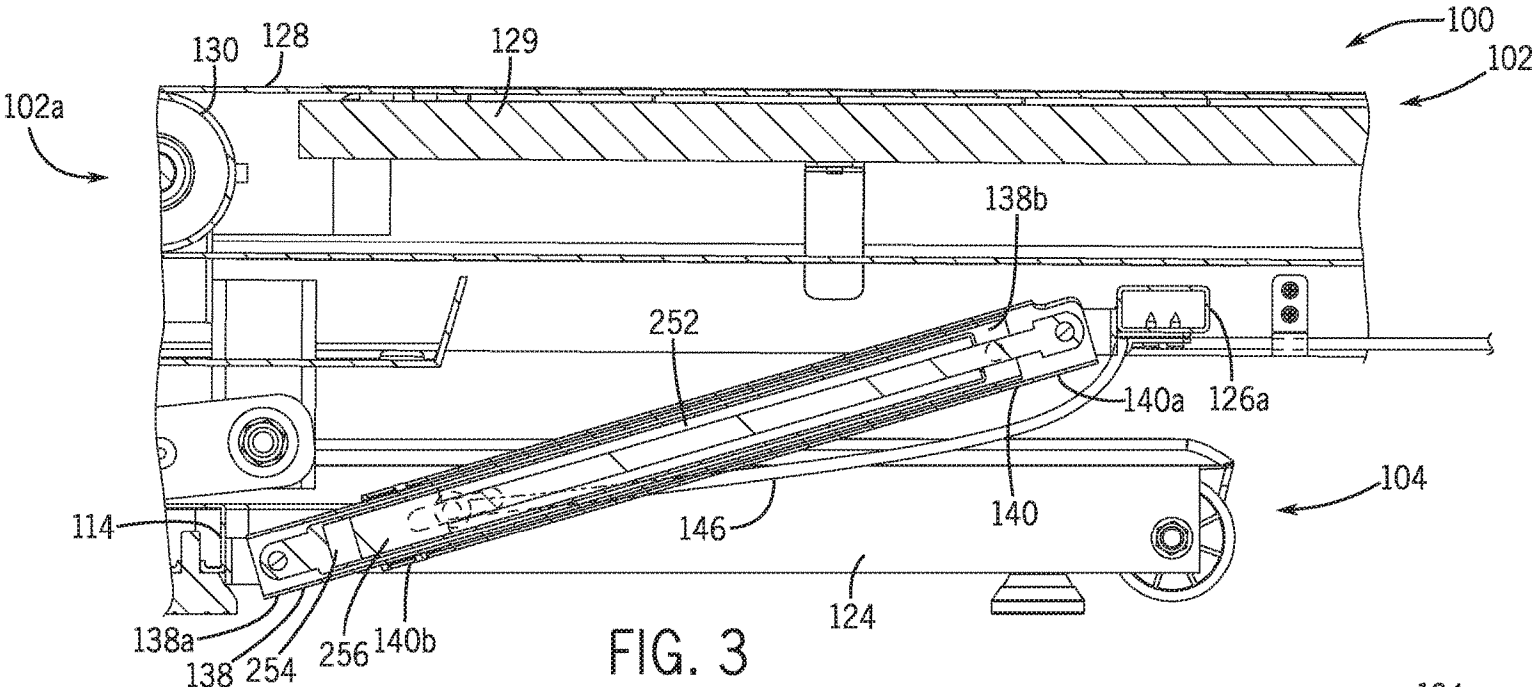
FIG. 3 is a cross-sectional view of a portion of the treadmill of FIG. 1 taken along line 3-3 in FIG. 1 according to one embodiment of the present disclosure.

FIG. 3 shows a cross-sectional view of the treadmill 100 taken along line 3-3 in FIG. 1. Referring to FIG. 3, the inner tube 138 may be telescopically received in the outer tube 140. The inner tube 138 may be pivotally connected at a first end portion 138*a* to the cross member 114 of the base frame 104 and may include a second end portion 138*b* distal the first end portion 138*a*. The outer tube 140 may be pivotally connected at a first end portion 140*a* to the cross member 126*a* of the deck assembly 102 and may include a second end portion 140*b* distal the first end portion 140*a*. The second end portion 138*b* of the inner tube 138 may be slidably received inside the outer tube 140 such that the outer tube 140 slides along an outer perimeter of the inner tube 138 during movement of the deck assembly 102 between the operating position shown in FIG. 1 and the storage position shown in FIG. 2.

Figure 4:
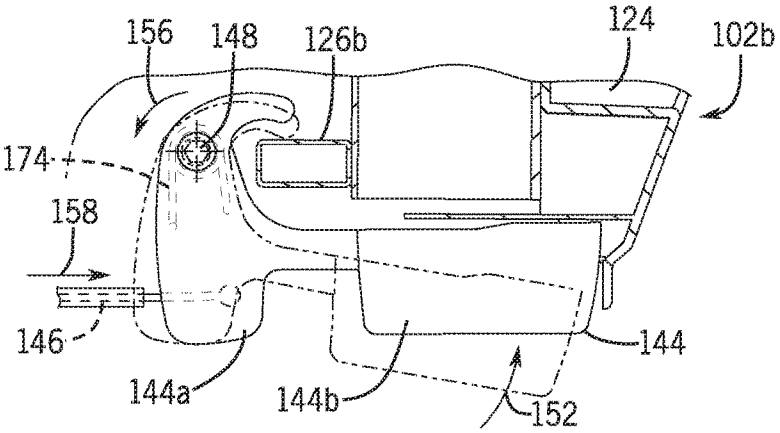
FIG. 4 is a cross-sectional view of a portion of the treadmill of FIG. 1 taken along line 4-4 in FIG. 1 according to one embodiment of the present disclosure.

To move the deck assembly 102 from the operating position shown in FIG. 1 to the storage position shown in FIG. 2, the user may engage the actuator member 144 to disengage the lock mechanism 142. Referring to FIG. 4, the actuator member 144 may be pivotally connected to the frame rail 124 near the rear end portion 102*b* of the deck assembly 102. By pressing upward on a rear end portion 144*b* of the actuator member 144 generally along arrow 152 in FIG. 4, the actuator member 144 pivots about a pivot axis 148 (see arrow 156) and causes a front end portion 144*a* of the actuator member 144 to move downwardly and rearwardly. This downward and rearward motion of the front end portion 144*a* of the actuator member 144 causes the cable 146 to move rearwardly generally along arrow 158 in FIG. 4. The rearward motion of the cable 146 disengages the lock mechanism 142, thereby permitting the deck assembly 102 to be moved upwardly relative to the frame 104 into the storage position of FIG. 2.

Figure 5:
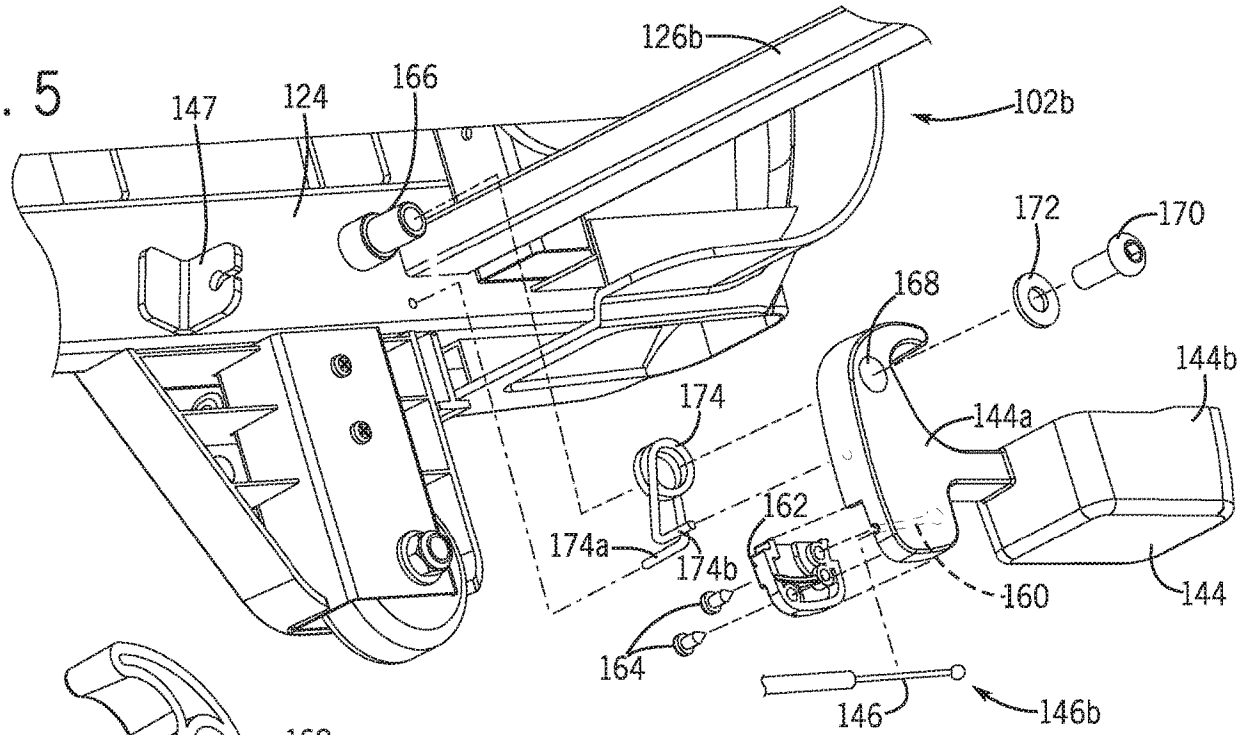
FIG. 5 is a partial exploded view of a portion of the treadmill of FIG. 1 according to one embodiment of the present disclosure.
Figure 6:
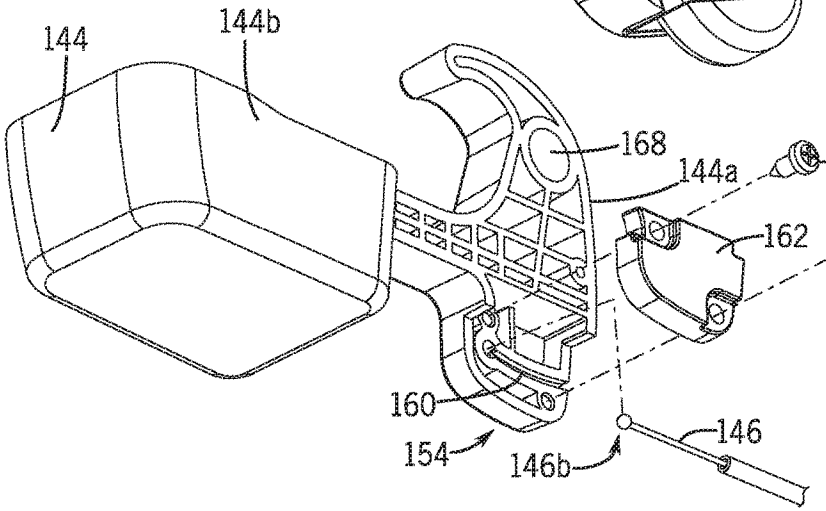
FIG. 6 is an exploded view of an actuator member according to one embodiment of the present disclosure.

Referring to FIGS. 5 and 6, the actuator member 144 may be operatively connected to the cable 146 such that movement of the actuator member 144 causes the cable 146 to move, and vice versa. The front end portion 144*a* of the actuator member 144 may define a channel 160 for receiving a rear end portion 146*b* of the cable 146, and a cover plate 162 may secure the rear end portion 146*b* in the channel 160. The cover plate 162 may be releasably connected to the front end portion 144*a* of the actuator member 144 with at least one fastener 164, for example.

With continued reference to FIGS. 5 and 6, the actuator member 144 may be pivotally mounted onto a post 166 projecting inwardly from the right frame rail 124 generally toward the left frame rail 122. The post 166 may be received within an aperture 168 formed in the front end portion 144*a* of the actuator member 144, and a fastener 170 may secure the front end portion 144*a* to the post 166. A washer 172 may be positioned between the front end portion 144*a* and the fastener 170.

Referring still to FIGS. 5 and 6, a biasing member 174 may bias the actuator member 144 into a position corresponding to an engaged position of the lock mechanism 142. The lock mechanism 142 may provide a sufficient biasing force to reset the actuator member 144 after being depressed by a user, and such biasing force may be transferred to the actuator member 144 through the cable 146. The biasing member 174 may optionally provide a supplemental biasing force to ensure the actuator member 144 is reset after being depressed by a user. For example, referring back to FIG. 4, the biasing member 174 may bias the actuator member 144 from a depressed position (see the solid-line representation of the actuator member 144 in FIG. 4) towards a non-depressed position (see the dashed-line representation of the actuator member 144 in FIG. 4), which movement may cause the cable 146 to move in a direction opposite that of arrow 158. To ensure the actuator member 144 is reset into a consistent non-depressed position, the actuator member 144 may contact a stop, such as the cross member 126*b*, when the actuator member 144 is fully reset.

With continued reference to FIGS. 5 and 6, the biasing member 174 may be a torsion spring. The torsion spring 174 may include a first tang 174*a* connected to the frame rail 124 and a second tang 174*b* connected to the front end portion 144*a* of the actuator member 144 such that the torsion spring 174 provides a biasing force upon pivotal movement of the actuator member 144 relative to the frame rail 124. The first and second tangs 174*a*, 174*b* may extend in generally opposite directions. As shown in FIG. 5, the biasing member 174 may be mounted onto the post 166 between the frame rail 124 and the front end portion 144*a* of the actuator member 144.

Figure 7:
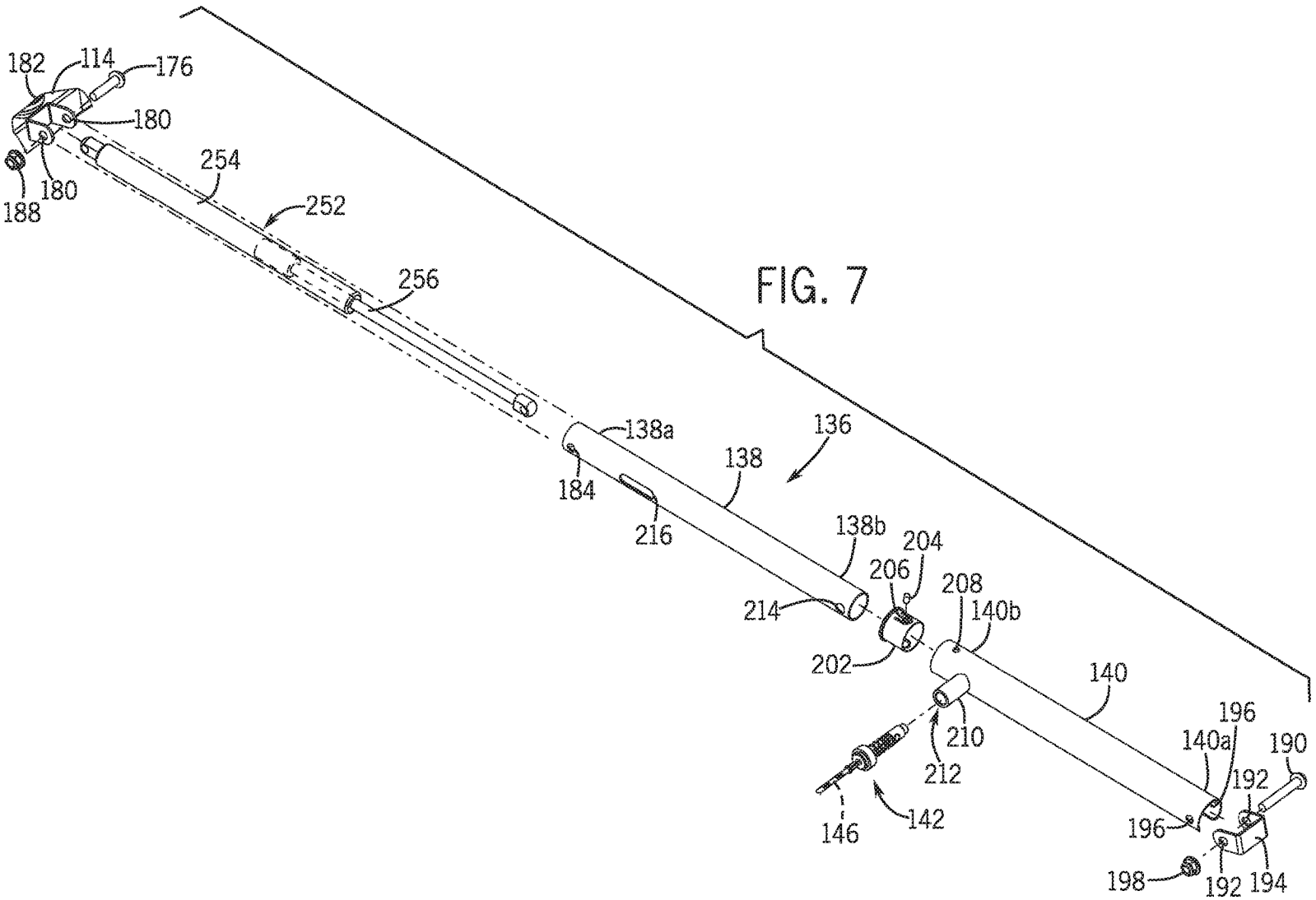
FIG. 7 is a partial exploded view of a lock system of the treadmill of FIG. 1 according to one embodiment of the present disclosure.

FIG. 7 shows a partial exploded view of the lock system 136 of the treadmill 100. The lock system 136 may include the inner tube 138 and the outer tube 140. The first end portion 138*a* of the inner tube 138 may be pivotally connected to the cross member 114 via a fastener, such as the illustrated bolt 176, that is inserted through apertures 180 formed in a bracket 182 (which is connected to the cross member 114) and apertures 184 formed in the first end portion 138*a* of the inner tube 138, and secured in place by a nut 188, for example. Similarly, the first end portion 140*a* of the outer tube 140 may be pivotally connected to the cross member 126*a* (see FIG. 3) via a fastener, such as the illustrated bolt 190, that is inserted through apertures 192 formed in a bracket 194 (which is connected to the cross member 126*a*) and apertures 196 formed in the first end portion 140*a* of the outer tube 140, and secured in place by a nut 198, for example. A collar 202 may be inserted into the end of the second end portion 140*b* of the outer tube 140 and secured in place by a fastener 204 inserted through an aperture 206 formed in the collar 202 and received in an aperture 208 formed in the second end portion 140*b*. The collar 202 may support the inner tube 138 within the outer tube 140 and may function as a bearing for the inner tube 138 to slide within during movement of the deck assembly 102 between the operating position of FIG. 1 and the storage position of FIG. 2.

With continued reference to FIG. 7, the lock mechanism 142 may be operatively connected to the outer tube 140 to selectively engage one or more engagement features of the inner tube 138. The lock mechanism 142 may be received within a housing 210 that is connected to the outer tube 140, and the housing 210 may define an interior cavity 212 that opens into an interior space of the outer tube 140. When received in the housing 210, the lock mechanism 142 may selectively protrude into the interior space of the outer tube 140 to engage the engagement features of the inner tube 138 to restrain the deck assembly 102 in the operating position of FIG. 1 or the storage position of FIG. 2. The lock mechanism 142 may be actuated by the movement of the cable 146, which may be caused by user movement of the actuator member 144 (see FIGS. 4-6).

Referring still to FIG. 7, the inner tube 138 may define multiple engagement features for engagement by the lock mechanism 142 to secure the deck assembly 102 in the operating position of FIG. 1 and the storage position of FIG. 2. The inner tube 138 may define a first engagement feature, such as the aperture 214, and a second engagement feature, such as the slot 216. The lock mechanism 142 may engage the aperture 214 when the deck assembly 102 is in the storage position of FIG. 2 and may engage the slot 216 when the deck assembly 102 is in the operating position of FIG. 1. The slot 216 may extend lengthwise along a length of the inner tube 138 and may be dimensioned to allow relative movement between the inner tube 138 and the outer tube 140 when the lock mechanism 142 is at least partially inserted into the slot 216. The relative movement between the inner tube 138 and the outer tube 140 may accommodate incline adjustment of the deck assembly 102 during operation of the treadmill 100, while ensuring the deck assembly 102 is secured in the operation position of FIG. 1.

Figures 8, 9, 10, 11:
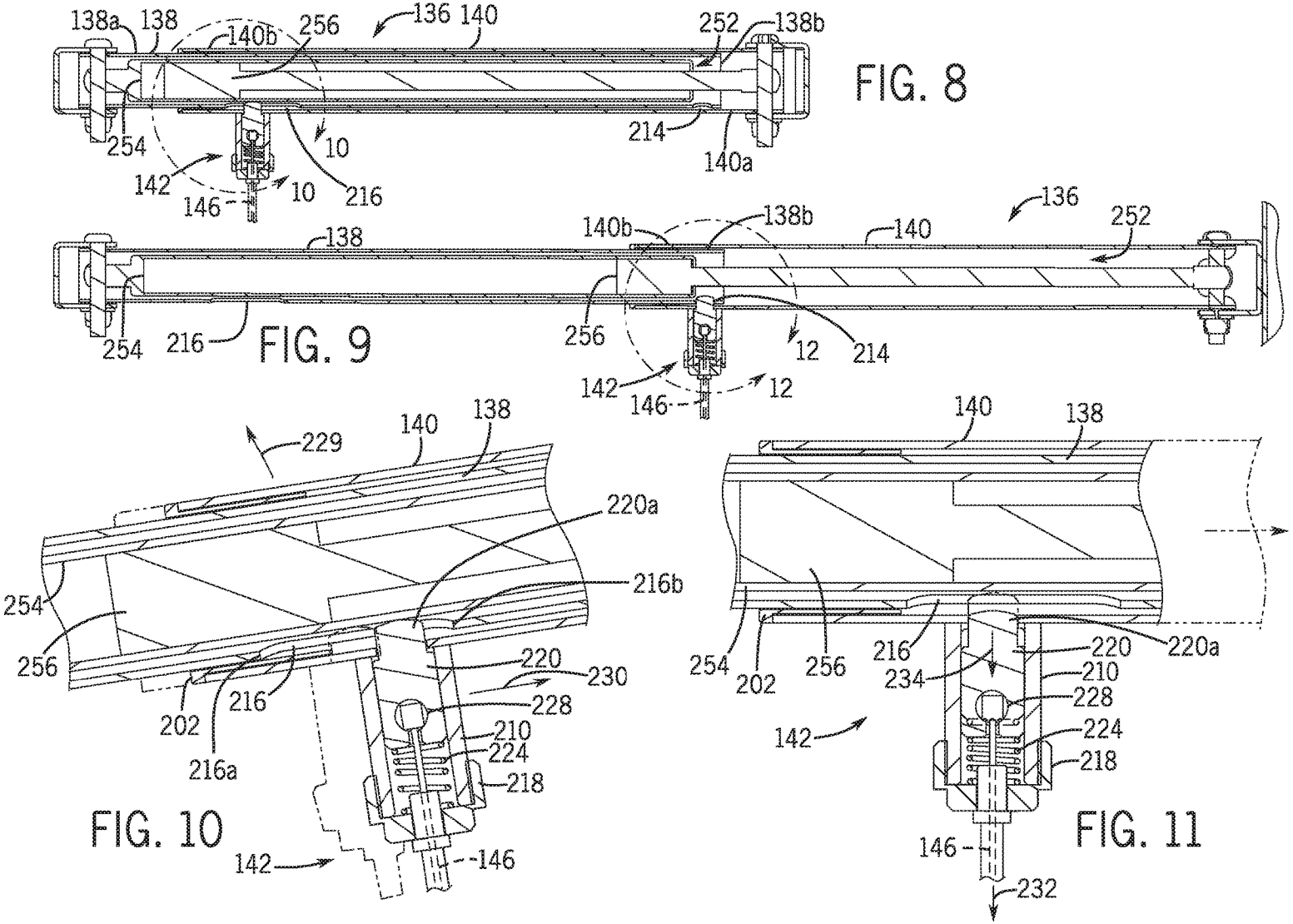
FIG. 8 is a cross-sectional view of the lock system of FIG. 7 taken along line 8-8 in FIG. 1 according to one embodiment of the present disclosure.
FIG. 9 is a cross-sectional view of the lock system of FIG. 7 taken along line 9-9 in FIG. 2 according to one embodiment of the present disclosure.
FIG. 10 is an enlarged view of the lock system of FIG. 8 circumscribed by line 10-10 in FIG. 8 according to one embodiment of the present disclosure.
FIG. 11 is an enlarged view of the lock system of FIG. 8 showing movement of a lock mechanism during inclination of deck assembly while using the treadmill according to one embodiment of the present disclosure.

FIGS. 8 and 9 show cross-sectional views of the lock system 136 when the treadmill 100 is in the operating and storage configurations of FIGS. 1 and 2, respectively. As illustrated in FIG. 8, when the treadmill 100 is in the operating configuration of FIG. 1, the first and outer tubes 138, 140 may be collapsed such that the second end portion 138*b* of the inner tube 138 is located close to the first end portion 140*a* of the outer tube 140, and the second end portion 140*b* of the outer tube 140 is located close to the first end portion 138*a* of the inner tube 138. When the treadmill 100 is in the operating configuration of FIG. 1, the lock mechanism 142 is inserted at least partially into the slot 216 of the inner tube 138, thereby permitting a user to adjust the incline of the deck assembly 102 without disengaging the lock mechanism 142 from the slot 216.

As illustrated in FIG. 9, when the treadmill 100 is in the storage configuration of FIG. 2, the first and outer tubes 138, 140 may be extended away from each other such that the second end portion 140*b* of the outer tube 140 overlaps the second end portion 138*b* of the inner tube 138. When the treadmill 100 is in the storage configuration of FIG. 2, the lock mechanism 142 is inserted at least partially into the aperture 214 of the inner tube 138, thereby fixing the position of the first and outer tubes 138, 140 relative to each other and holding the deck assembly 102 in the storage position of FIG. 2.

Figure 12:
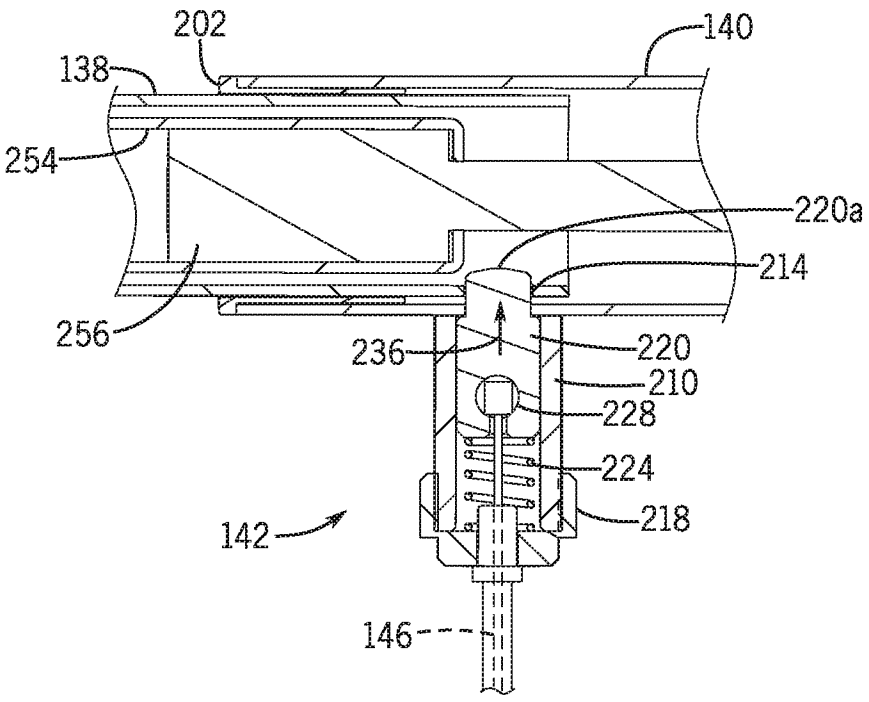
FIG. 12 is an enlarged view of the lock system of FIG. 9 circumscribed by line 12-12 in FIG. 9 according to one embodiment of the present disclosure.

FIGS. 10-12 provide enlarged views of the lock mechanism 142, which may be formed as a pop-pin assembly. As illustrated in FIGS. 10-12, the housing 210 of the lock mechanism 142 may be connected to the outer tube 140, and may be oriented substantially perpendicular to the outer tube 140. The housing 210 may be formed as a cylinder and a cap 218 may be mounted onto the housing 210 to secure an engagement member 220 within the housing 210. The engagement member 220 may be slidably received within the housing 210 such that the engagement member 220 is movable between an engaged position in which the engagement member engages the first or second engagement features of the inner tube 138 and a disengagement position in which the engagement member is disengaged from the first and second engagement features of the inner tube 138. The engagement member 220 may be referred to as a pin. A biasing member, such as a spring 224, may be disposed between the housing cap 218 and the engagement member 220, and the spring 224 may urge the engagement member 220 away from the housing cap 218 and toward the inner tube 138. The cable 146 may be insertable through an aperture formed in the housing cap 218 and connected to the engagement member 220. As illustrated in FIGS. 10-12, an end of the cable 146 may be retained in an aperture 228 formed in the engagement member 220. Alternatively, the cable 146 may be attached to the engagement member 220 by any known method or device.

In operation, the spring 224 in FIGS. 10-12 may apply a biasing force to the engagement member 220, thereby urging an end portion 220*a* of the engagement member 220 to extend from the housing 210 into an interior space defined by the outer tube 140. By extending into the interior space defined by the outer tube 140, the end portion 220*a* of the engagement member 220 may extend into the aperture 214 of the inner tube 138 when the end portion 220*a* is aligned with the aperture 214, the slot 216 of the inner tube 138 when the end portion 220*a* is aligned with the slot 216, or may ride along an outer surface of the inner tube 138 when the end portion 220*a* is not aligned with the aperture 214 or the slot 216. The extension of the engagement member 220 into the aperture 214 generally prevents relative movement between the inner tube 138 and the outer tube 140, thereby precluding movement of the deck assembly 102 relative to the base frame 104. The extension of the engagement member 220 into the slot 216 generally confines movement of the inner tube 138 relative to the outer tube 140, thereby limiting movement of the deck assembly 102 relative to the base frame 104. According to one embodiment, the engagement member 220 is received within the aperture 214 when the treadmill 100 is in the storage configuration of FIG. 2, and the engagement member 220 is received within the slot 216 when the treadmill 100 is in the operating configuration of FIG. 1.

During use of the treadmill 100, a user may adjust the incline of the deck assembly 102, causing the front end portion 102*a* of the deck assembly 102 to rise relative to the rear end portion 102*b*. During this inclination of the deck assembly 102, the first and outer tubes 138, 140 generally pivot in an upward direction (see arrow 229 in FIG. 10) about the pivot connection of the inner tube 138 to the base frame 104, and the first and outer tubes 138, 140 move linearly away from each other as the distance between their connection points to the base frame 104 and the deck assembly 102, respectively, increases. During this separation of the first and outer tubes 138, 140, the lock mechanism 142 generally moves in unison with the outer tube 140 (see arrow 230 in FIG. 10), causing the end portion 220*a* of the engagement member 220 to slide within the slot 216. The length of the slot 216 may be based on a maximum incline angle of the deck assembly 102.

Referring to FIG. 10, when the treadmill is in the operating configuration of FIG. 1, the engagement member 220 may extend into the slot 216 of the inner tube 138. As shown in FIG. 10, the slot 216 is elongated and has a length defined between a lower end 216*a* and an upper end 216*b*. The engagement member 220 may be spaced from the upper end 216*b* of the slot 216 when the deck assembly 102 is oriented generally horizontally (see dashed line representation of the engagement member 220 in FIG. 10), and the distance between the engagement member 220 and the upper end 216 of the slot 216 generally permits incline adjustment of the deck assembly 102 while the engagement member 220 is positioned within the slot 216. During incline of the deck assembly 102, the end portion 220*a* of the engagement member 220 may slide in a substantially straight line along the length of the slot 216 toward the upper end 216*b* of the slot 216 and the second end portion 138*b* of the inner tube 138 (see FIG. 8 and arrow 230 in FIG. 10).

Referring still to FIG. 10, lifting of the rear end portion 102*b* of the deck assembly 102 (resulting in a decline of the deck assembly 102) may cause the engagement member 220 to slide within the slot 216 toward the upper end 216*b* of the slot 216 and the second end portion 138*b* of the inner tube 138. As such, when the deck assembly 102 is in the operating position of FIG. 1, a user may lift the rear end portion 102*b* of the deck assembly 102 a distance without having to first extract the engagement member 220 from the slot 216. In other words, a user may lift the rear end portion 102*b* of the deck assembly 102 until the end portion 220*a* of the engagement member 220 abuts against the upper end 216*b* of the slot 216, at which point the user may depress the actuator member 144 (see FIG. 1) to disengage the engagement member 220 from the slot 216 and continue lifting the rear end portion 102*b* of the deck assembly 102 toward the storage position of FIG. 2.

Referring to FIG. 11, to reposition the treadmill 100 from the operating position of FIG. 1 into the storage configuration of FIG. 2 (see FIGS. 1 and 2), the user may reach under the rear end portion 102*b* of the deck assembly 102 (see FIG. 1) and apply an upward force on the actuator member 144 to pivot the actuator member 144 relative to the frame rail 124 (see FIG. 4), causing the cable 146 to move transversely away from the first and outer tubes 138, 140 (see arrow 232 in FIG. 11) against the bias of spring 224 until the end portion 220*a* of the engagement member 220 is extracted from the slot 216 (see arrow 234 in FIG. 11 representing the motion of the engagement member 220 from an extended position (dashed line representation) to a non-extended position (solid line representation)). As previously described, the user may lift the rear end portion 102*b* of the deck assembly 102 slightly before depressing the actuator member 144 to provide the user better initial access to the actuator member 144. Once the engagement member 220 is extracted from the slot 216 (see FIG. 11), the outer tube 140 is free to move relative to the inner tube 138, and thus the deck assembly 102 is free to pivot relative to the base frame 104. Once the user moves the deck assembly 102 upward a sufficient distance such that the engagement member 220 is no longer in alignment with the slot 216 in the inner tube 138, the user may release the actuator member 144, which allows the spring 224 to force the end portion 220*a* of the engagement member 220 against the side wall of the inner tube 138.

Referring to FIG. 12, once the deck assembly 102 is lifted to the upright storage position such that the engagement member 220 is aligned with the aperture 214, the spring 224 forces the end portion 220*a* of the engagement member 220 into the aperture 214 (see arrow 236 in FIG. 12), which holds the inner tube 138 in a fixed position relative to the outer tube 140, locking the deck assembly 102 in the storage position of FIG. 2. The force of the spring 224 may cause the cable 146 to move away from the actuator member 144 and reset the position of the actuator member 144 (see dashed line representation of actuator member in FIG. 4). To return the deck assembly 102 to the operating configuration of FIG. 1, the user may depress the actuator member 144 to extract the end portion 220*a* of the engagement member 220 from the aperture 214 and then lower the deck assembly 220 until the spring 224 forces the end portion 220*a* of the engagement member 220 into the slot 216 (see FIG. 8). With the engagement member 220 engaged in the slot 216, a user may adjust the incline of the deck assembly 102 relative to the frame 104 without extracting the engagement member 220 from the slot 216.

FIGS. 3 and 7-9 show a lift assistance mechanism 252 configured to resist pivotal movement of the deck assembly 102 in the downward direction. The lift assistance mechanism 252 controls the rate at which the deck assembly 102 moves when pivoting downward from the storage position of FIG. 2 to the operating position of FIG. 1 to prevent the deck assembly 102 from pivoting downward at a relatively high rate of speed, such as during a free fall. In addition, the lift assistance mechanism 252 facilitates lifting and pivoting of the deck assembly 102 from the operating configuration of FIG. 1 to the storage configuration of FIG. 1 by providing a supplemental force that reduces the force required to lift and pivot the deck assembly 102.

In the embodiment shown in FIGS. 3 and 7-9, the lift assistance mechanism 252 is positioned inside the inner tube 138 and the outer tube 140. The illustrated lift assistance mechanism 252 comprises a lift cylinder including a cylinder body 254 operatively connected with a piston 256. As shown in FIG. 3, the cylinder body 254 may be pivotally connected to the cross member 114 of the base frame 104 at the same pivot connection as the inner tube 138 to the cross member 114, and the piston 256 may be pivotally connected to the cross member 126*a* of the deck assembly 102 at the same pivot connection as the outer tube 140 to the cross member 126*a*. The piston 256 may include a head positioned within the cylinder body 254, and the cylinder body 254 may contain pressurized air that resists downward motion of the piston head within the cylinder body 254, thereby resisting downward pivotal motion of the deck assembly 102 relative to the base frame 104. In other words, pressurized air inside the cylinder body 254 acts to force the piston head away from the pivotal connection of the cylinder body 254 to the cross member 114 of the base frame 104, which in turn resists downward pivotal motion of the deck assembly 102 relative to the base frame 104. During use, the piston 256 extends from and compresses into the cylinder body 254 as the deck assembly 102 pivots up and down relative to the base frame 104, respectively. As shown in FIG. 9, the lift cylinder 252 defines a relatively extended length when the deck assembly 102 is in the upright storage position of FIG. 2. Conversely, as shown in FIG. 8, the lift cylinder 252 defines a relatively compressed length when the deck assembly 102 is in the downward operating position of FIG. 1. As the deck assembly 102 pivots from the storage position of FIG. 2 to the operating position of FIG. 1, movement of the piston 256 into the cylinder body 254 may cause the air pressure inside the cylinder body 254 to increase, resulting in an increased force exerted by the lift cylinder.

Various sizes, types, and arrangements of lift cylinders may be used and are not limited to the arrangement depicted and described herein. Depending on the length and weight of the deck assembly, the lift mechanism may include more than one lift cylinder. Further, the lift assistance mechanism is not limited to having air pressurized lift cylinders and can include any mechanism capable of applying an upward force on the deck assembly, such as a spring or hydraulic system.

In use, a user can disengage the lock mechanism 142 by applying an upward force to the actuator member 144. More particularly, when a user presses upward on the actuator member 144, the actuator member 144 pulls the cable 146 attached thereto in a rearward direction, and the cable 146 in turn operates to disengage the lock mechanism 142. As previously described, the movement of the cable 146 may cause the engagement member 220 to be withdrawn from the aperture 214 and the slot 216 in the inner tube 138, thereby disengaging the lock mechanism 142 and enabling repositioning of the deck assembly 102 between operating and storage positions. When the user releases the actuator member 144, the spring 224 extends the engagement member 220 toward the inner tube 138, which causes the cable 146 to pull on the actuator member 144 and pivot the actuator member 144 into its original non-depressed position.

Using the actuator member 144 with the lock mechanism 142 is merely exemplary. For example, the actuator member 144 may be used with other lock mechanisms capable of restricting relative movement between the first and outer tubes 138, 140, and similarly the lock mechanism 142 may be used with other actuator members capable of moving the engagement member 220 between extended and non-extended positions. For example, instead of having the lever described above, other forms of the actuator member may include a knob or handle located on the deck assembly and adapted to slide, pivot, rotate, or move in other manners to actuate the lock mechanism. The actuator member may be operatively connected with the engagement member mechanically, electrically (wired or wirelessly), or both. The term "tube" as used herein includes structures that are at least partially hollow, have a length dimension longer than a width dimension, and may include a cross section that is continuous or discontinuous along its length. The cross sectional shape of an example tube may be of a geometric shape, such as including without limitation circular, oval, square, rectangular, trapezoidal, or star-shaped. The cross sectional shape of an example tube may receive another tube having a corresponding cross sectional shape or another shape such that the two tubes are telescopically movable relative to one another.

Although various representative embodiments of this invention have been described above with a certain degree of particularity, those skilled in the art could make numerous alterations to the disclosed embodiments without departing from the scope of the subject matter set forth in the specification and claims. For example, a lock mechanism of the present disclosure may be used with various types of treadmills and should not be construed to be limited to function with only the treadmill shown in FIGS. 1 and 2, which is merely exemplary.

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "portions" having a particular characteristic and/or being connected with another part. However, those skilled in the art will recognize that the present invention is not limited to components which terminate immediately beyond their points of connection with other parts. Thus, the term "portion" should be interpreted broadly, in a manner that includes areas adjacent, rearward, forward of, or otherwise near the terminus of a particular element, link, component, part, member, or the like. In methodologies directly or indirectly set forth herein, various steps and operations are described in one possible order of operation, but those skilled in the art will recognize that steps and operations may be rearranged, replaced, or eliminated without necessarily departing from the scope of the present invention.

Any one of the above embodiments or processes may be combined with one or more other embodiments and/or processes or be separated and/or performed amongst separate devices or device portions in accordance with the present systems, devices, and methods. The description of exemplary embodiments is intended to be merely illustrative of examples in accordance with the present disclosure and should not be construed as limiting the appended claims to any particular embodiment or group of embodiments. Thus, while examples have been described in particular detail with reference to exemplary embodiments, numerous modifications and alternative embodiments may be devised by those having ordinary skill in the art without departing from the broader and intended scope of the present disclosure as set forth in the claims that follow. Accordingly, the specification and drawings are to be regarded in an illustrative manner and are not intended to limit the scope of the appended claims.

What is claimed is:

1. A treadmill comprising:

a frame;

a deck assembly including a front end portion pivotally connected to the frame, the deck assembly positionable in an operating position and a storage position;

a first tube connected to one of the frame or the deck assembly, the first tube defining an aperture and a slot spaced apart from each other along a length of the first tube, wherein the slot extends lengthwise along the length of the first tube;

a second tube connected to the other of the frame or the deck assembly and slidably connected to the first tube; and a lock mechanism operative to lock the deck assembly in the operating position and the storage position, the lock mechanism comprising:

a pin operatively connected to the second tube and engageable with the aperture and the slot of the first tube; wherein:

engagement of the pin with the aperture locks the deck assembly in the storage position; and engagement of the pin with the slot locks the deck assembly in the operating position while allowing incline adjustment of the front end portion of the deck assembly relative to the frame during operation of the treadmill, wherein the slot is dimensioned to receive at least a portion of the pin and allow the pin to slide within the slot.

2. The treadmill of claim 1, wherein engagement of the pin with the aperture substantially prevents the deck assembly from being moved relative to the frame.

3. The treadmill of claim 1, wherein disengagement of the pin from the aperture and the slot allows the deck assembly to be moved relative to the frame between the operating position and the storage position.

4. The treadmill of claim 1, wherein the aperture is dimensioned to receive at least a portion of the pin and substantially prevent the deck assembly from being moved relative to the frame.

5. The treadmill of claim 1, wherein:

the first tube includes a first end portion pivotally connected to the one of the frame or the deck assembly and a second end portion distal to the first portion; and the slot is located between the aperture and the first end portion of the first tube.

6. The treadmill of claim 1, wherein:

the second tube includes a first end portion pivotally connected to the other of the frame or the deck assembly and a second end portion distal to the first portion; and the pin is connected to the second tube proximate to the second end portion of the second tube.

7. The treadmill of claim 1, wherein the pin is slidable between a first position in which the pin is engaged with the aperture or the slot and a second position in which the pin is disengaged from the aperture and the slot.

8. The treadmill of claim 7, further comprising a spring that biases the pin towards the first position.

9. The treadmill of claim 1, further comprising a handle positioned remote from the pin and operatively associated with the pin to disengage the pin from the aperture and the slot.

10. The treadmill of claim 9, wherein the handle is pivotally connected to the deck assembly such that pivotal motion of the handle relative to the deck assembly disengages the pin from the aperture or the slot.

11. The treadmill of claim 9, wherein:

the deck assembly has a rear end portion distal to the front end portion; and the handle is pivotally connected to the rear end portion of the deck assembly.

12. The treadmill of claim 9, further comprising a cable that operatively connects the handle to the pin.

13. The treadmill of claim 9, further comprising a spring operatively connected to the handle to bias the pin towards an engaged position.

14. The treadmill of claim 1, further comprising a lift assistance mechanism operatively connected to the frame and the deck assembly.

15. The treadmill of claim 14, wherein the lift assistance mechanism is at least partially received inside the first tube and the second tube.

16. The treadmill of claim 1, wherein the first tube is telescopically received in the second tube.

17. The treadmill of claim 1, further comprising an actuator operatively coupled to the pin to disengage the pin from the slot, wherein the actuator is positioned on the treadmill such that the actuator is accessible to a user when the deck assembly is in the operating position.

* * * * *